US011363927B2

(12) United States Patent
Mantes et al.

(10) Patent No.: US 11,363,927 B2
(45) Date of Patent: Jun. 21, 2022

(54) VACUUM CLEANER INCLUDING FILTER CLEANING DEVICE

(71) Applicant: MILWAUKEE ELECTRIC TOOL CORPORATION, Brookfield, WI (US)

(72) Inventors: Jonathan M. Mantes, Franklin, WI (US); Fraizier Reiland, Milwaukee, WI (US); Anthony R. Sleck, Lisbon, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 228 days.

(21) Appl. No.: 16/548,556

(22) Filed: Aug. 22, 2019

(65) Prior Publication Data

US 2020/0069130 A1 Mar. 5, 2020

Related U.S. Application Data

(60) Provisional application No. 62/724,767, filed on Aug. 30, 2018, provisional application No. 62/724,117, filed on Aug. 29, 2018.

(51) Int. Cl.

| | |
|---|---|
| ***A47L 9/20*** | (2006.01) |
| ***A47L 9/10*** | (2006.01) |
| ***A47L 5/22*** | (2006.01) |
| ***A47L 9/12*** | (2006.01) |

(52) U.S. Cl.

CPC ..... *A47L 9/20* (2013.01); *A47L 5/22* (2013.01); *A47L 9/102* (2013.01); *A47L 9/122* (2013.01)

(58) Field of Classification Search

CPC . A47L 5/22; A47L 9/102; A47L 9/122; A47L 9/20

See application file for complete search history.

(56) References Cited

U.S. PATENT DOCUMENTS

| | | | | |
|---|---|---|---|---|
| 4,557,738 | A * | 12/1985 | Menasian | A47L 9/20 55/288 |
| 5,704,956 | A * | 1/1998 | Loveless | B01D 46/04 55/305 |
| 6,949,130 | B1 * | 9/2005 | Grey | A47L 9/1666 55/305 |
| 8,424,154 | B2 * | 4/2013 | Beskow | A47L 9/20 15/352 |
| 10,561,290 | B2 * | 2/2020 | Pi | A47L 5/28 |

(Continued)

FOREIGN PATENT DOCUMENTS

CN 109662650 A * 4/2019

*Primary Examiner* — Marc Carlson

(74) *Attorney, Agent, or Firm* — Michael Best & Friedrich LLP

(57) ABSTRACT

A vacuum cleaner including a housing, a suction inlet, a suction source, a collector and a filtering unit. The housing includes a suction airflow through the housing. The suction source draws the suction airflow through the suction inlet. The collector receives debris separated from the suction airflow and is disposed between the suction inlet and the suction source. The filtering unit includes a filter, a retractable member, and a biasing member, where the retractable member is operable in directions towards and away from the filter for supplying momentary impact to the filter for providing agitations to rid the filter from debris. The biasing member urges the retractable member towards the filter.

20 Claims, 5 Drawing Sheets

(56) References Cited

U.S. PATENT DOCUMENTS

| | | | | |
|---|---|---|---|---|
| 2007/0209150 | A1* | 9/2007 | Gogel | A47L 9/19 15/352 |
| 2008/0250601 | A1* | 10/2008 | Coburn | A47L 9/125 15/352 |
| 2012/0047683 | A1* | 3/2012 | Kim | A47L 9/00 15/350 |
| 2012/0117927 | A1* | 5/2012 | Oh | A47L 9/122 55/296 |
| 2013/0312792 | A1* | 11/2013 | Hensel | F16K 17/042 134/18 |
| 2014/0215752 | A1* | 8/2014 | Loveless | A47L 9/1666 15/352 |
| 2014/0245566 | A1* | 9/2014 | Conrad | A47L 9/1666 15/353 |
| 2015/0251117 | A1* | 9/2015 | Madonia | B01D 35/02 134/6 |
| 2018/0084964 | A1* | 3/2018 | Pi | A47L 5/24 |

* cited by examiner

VACUUM CLEANER INCLUDING FILTER CLEANING DEVICE

CROSS-REFERENCE TO RELATED APPLICATIONS

This application claims priority to U.S. Provisional Patent Applications No. 62/724,117 filed on Aug. 29, 2018 and No. 62/724,767 filed on Aug. 30, 2018, the entire content of which is incorporated herein by reference.

BACKGROUND

The present invention relates to vacuum cleaners and more particularly to a vacuum cleaner including a filter cleaning device.

SUMMARY

In one embodiment, the invention provides a vacuum cleaner including a housing including a suction airflow, a suction inlet, and a suction source for drawing the suction airflow through the suction inlet. The vacuum cleaner further comprising a collector for receiving debris separated from the suction airflow and being disposed between the suction inlet and the suction source. The vacuum cleaner even further including a filter for filtering the suction airflow, a retractable member that is operable in directions toward and away from the filter for supplying momentary impact to the filter in order to provide agitation to rid the filter from debris, and a biasing member urging the retractable member towards the filter.

In another embodiment, the invention provides a vacuum cleaner including a motor operable for generating a suction airflow. The vacuum cleaner further including a filter for collecting debris separated from the suction airflow upstream of the motor and a retractable member movable between a first position and a second position. The vacuum cleaner even further including a biasing member coupled to the retractable member such that when the retractable member is released at any position between the first and second position the biasing member drives the retractable member toward the second position for delivering a shuttering force against the filter.

In yet another embodiment, the invention provides a vacuum cleaner including a housing including a suction airflow, a suction inlet, and a suction source for drawing the suction airflow through the suction inlet. The vacuum cleaner further comprising a collector for receiving debris separated from the suction airflow and being disposed between the suction inlet and the suction source. The vacuum cleaner even further including a filter for collecting debris separated from the suction airflow and positioned between the collector and the suction source. The vacuum cleaner even further including a filter for filtering a debris laden suction airflow, a retractable member that is operable away from and toward the filter that may be separated from the filter in in a first position and in contact with the filter in a second position, and a biasing member that urges the retractable member towards the filter, such that when the retractable member is released at any position between the first and second position, the biasing member drives the retractable member toward the filter for momentary impact between the retractable member and the filter.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Although the invention has been described in detail with reference to certain preferred embodiments, variations and modifications exist within the scope and spirit of one or more independent aspects of the invention as described.

Figure 1:
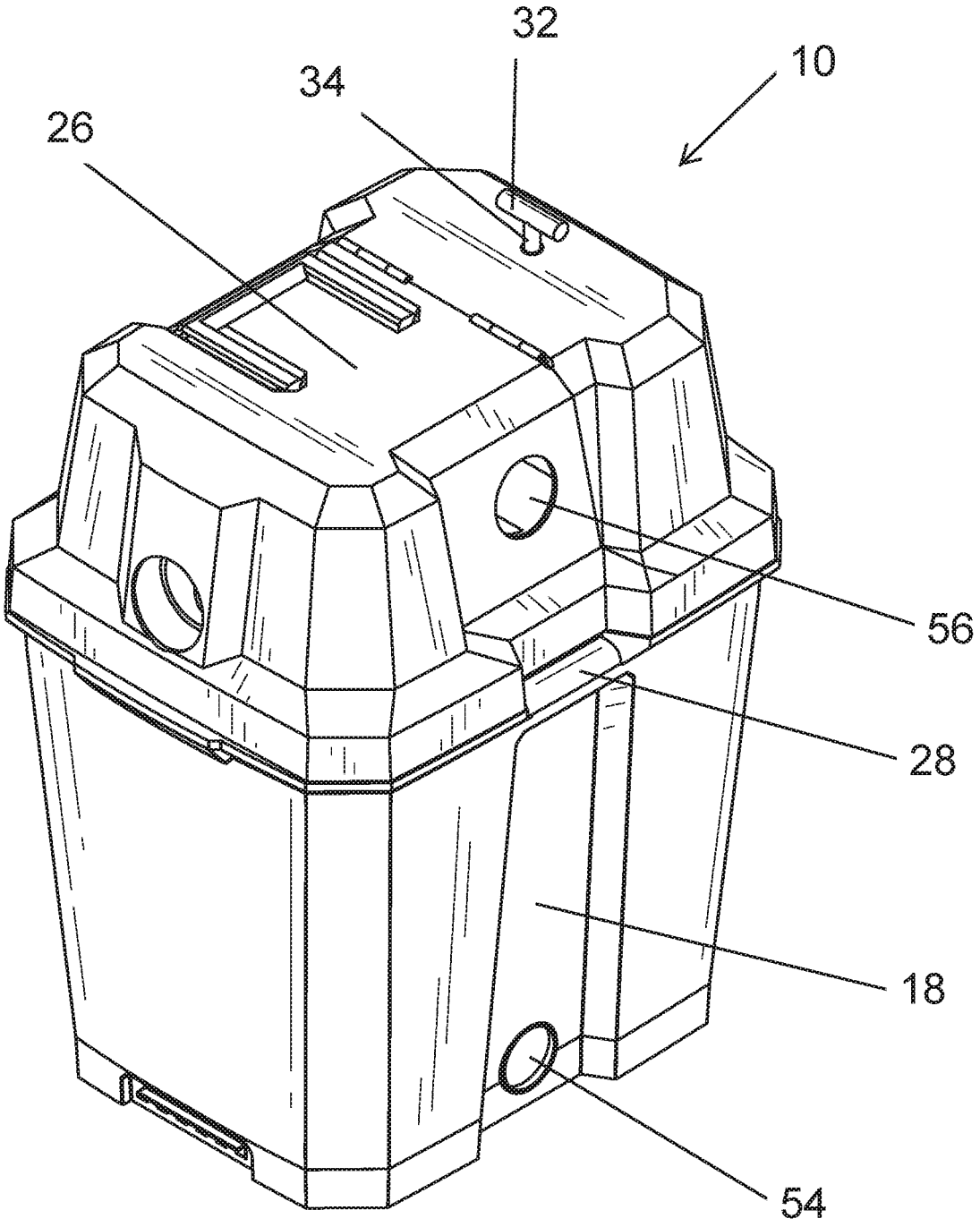
FIG. 1 is a perspective view of a vacuum cleaner.
Figure 2:
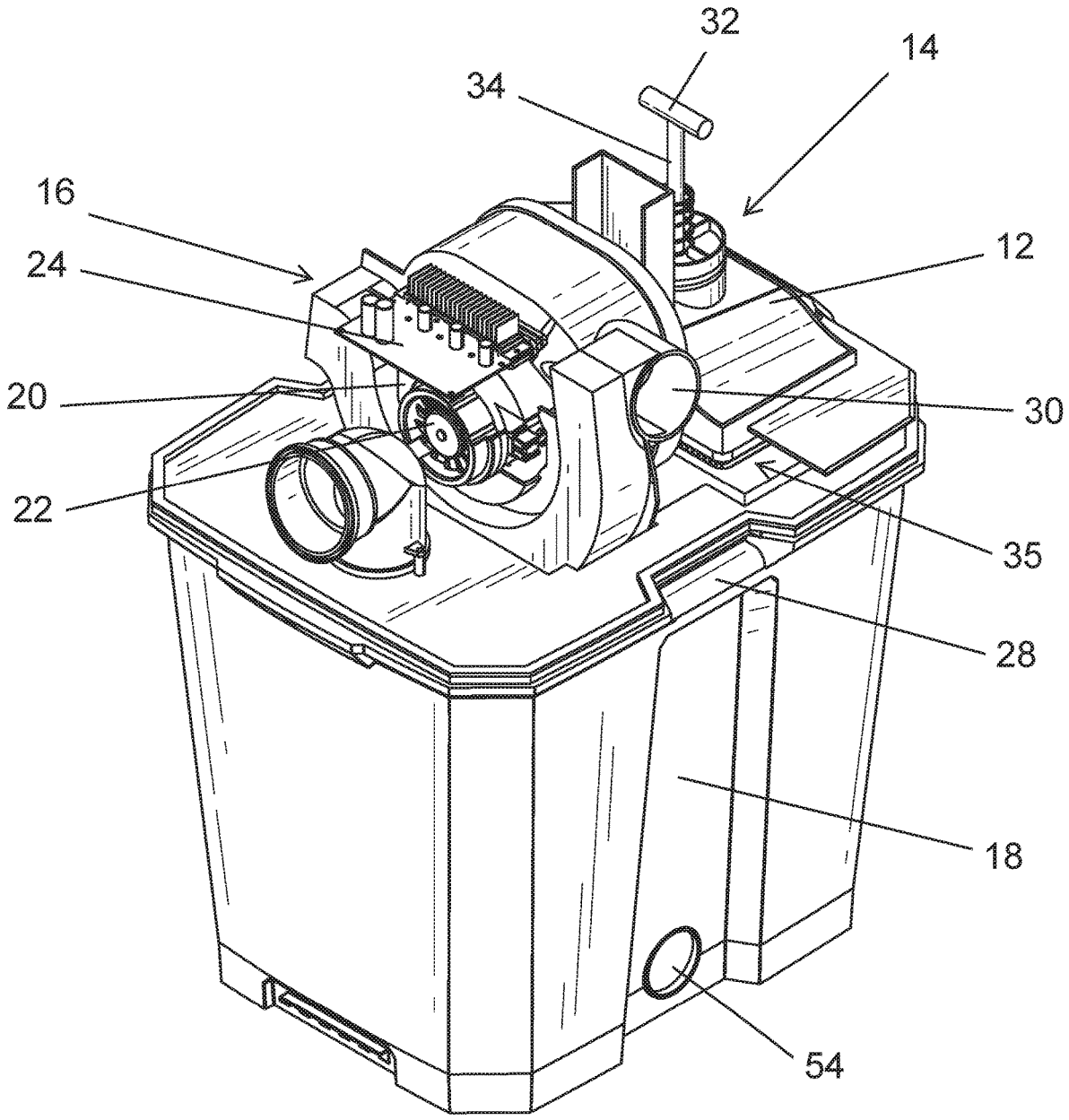
FIG. 2 is a perspective view of the vacuum cleaner of FIG. 1 with a lid removed.

FIGS. 1 and 2 illustrate a vacuum cleaner 10 that includes, a filter 12 and a filter cleaning device 14. As will be discussed in more detail below, the filter cleaning device 14 is operable to remove or dislodge debris from the filter 12.

With continued reference to FIGS. 1 and 2, the vacuum cleaner 10 includes a suction source 16 and a dirt collector 18. The suction source 16 includes a motor 20 and a fan 22 operable to generate a suction airflow within the vacuum cleaner 10. In the illustrated embodiment, the vacuum cleaner 10 includes a battery 24 to power the suction source 16. In another embodiment, the vacuum cleaner 10 may include an electrical cord for powering the suction by alternating current. The vacuum cleaner 10 further includes a lid 26 having a latch 28 that removably couples the lid 26 to the dirt collector 18. The lid 26 is removable from the dirt collector 18 to empty the dirt collector 18. In the illustrated embodiment, the suction source 16, the battery 24, and the filter 12 are disposed within the lid 26 and removable from the dirt collector 18 with the lid 26.

The dirt collector 18 includes a suction inlet 30. A suction hose or wand may be coupled to the inlet 30. The suction source 16 is operable to draw the suction airflow and debris into the dirt collector 18 through the inlet 30 from the external surrounding environment. The filter 12 is positioned upstream of the motor 20 such that remaining debris not deposited in the collector 18 is separated from the suction airflow and collected on the filter 12. The filter 12 assists in preventing a debris laden suction airflow from reaching the motor 20. In another embodiment, wheels may be coupled to the dirt collector 18 to facilitate movement of the vacuum cleaner 10 along a surface.

Referring now specifically to FIG. 2, the filter cleaning device 14 includes a handle 32 and a retractable member 34 aligned above the center of the filter 12. In the illustrated embodiment, the retractable member 34 is a rod. In another embodiment, the filter cleaning device 14 includes a tray 35 for receiving the filter 12, and the filter 12 is removeably coupled to the tray 35. The tray 35 slides between a closed or operating position and open position in which the filter 12 can be lifted or removed from the tray 35, and the filter 12 can be replaced with a new filter 12. In one embodiment, the filter 12 is a pleated cartridge HEPA (high efficiency particular air) filter. In other embodiments, other suitable types of filters can be used, such as foam filters or cloth filters. In the illustrated embodiment, the filter 12 includes a frame 36 and a filter media 38 that is connected to the frame 36. In another embodiment, the frame 36 is formed from rubber or another elastomeric material.

Figure 3:
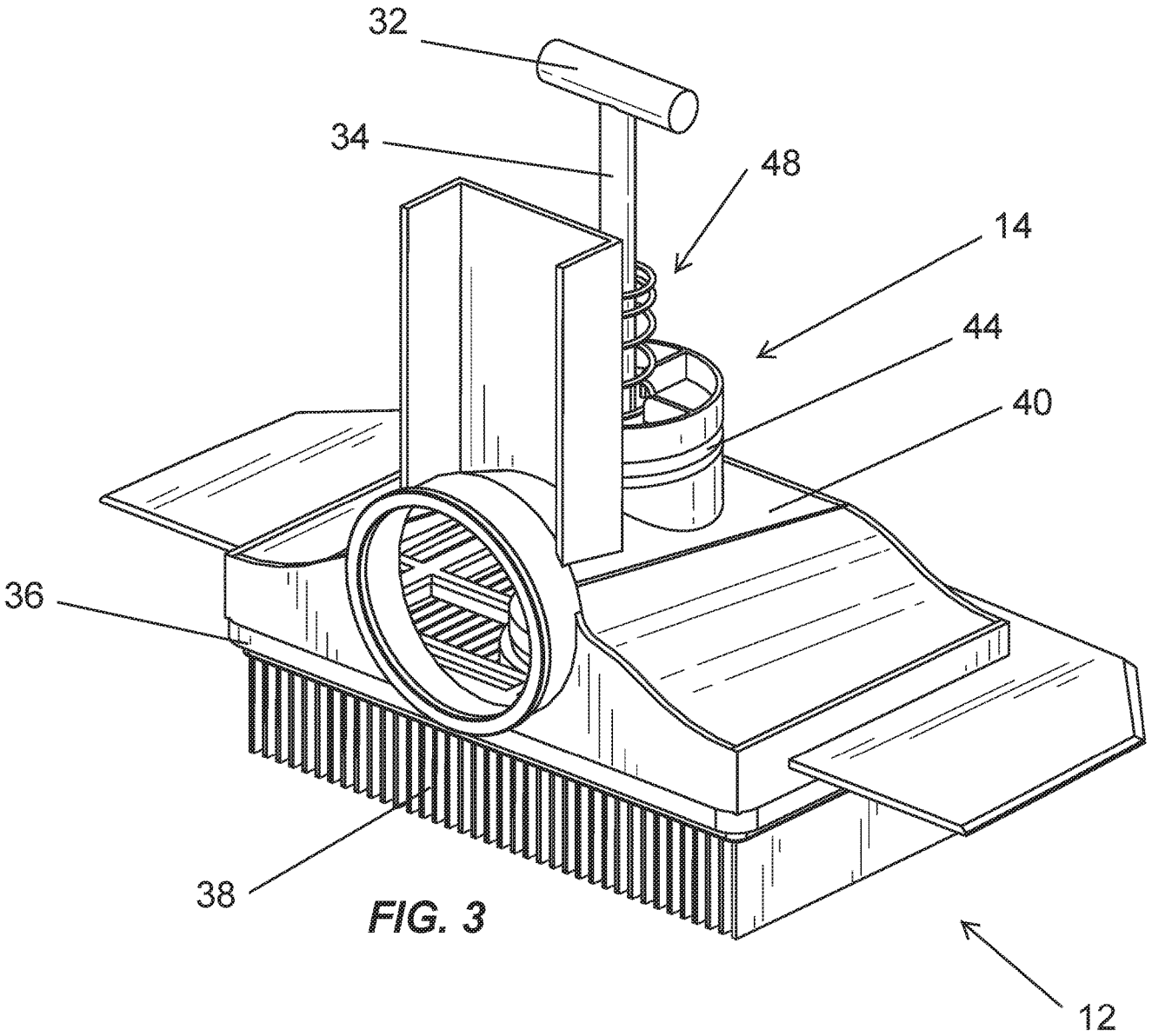
FIG. 3 is a perspective view of a filter cleaning device of the vacuum cleaner of FIG. 1.
Figure 4:
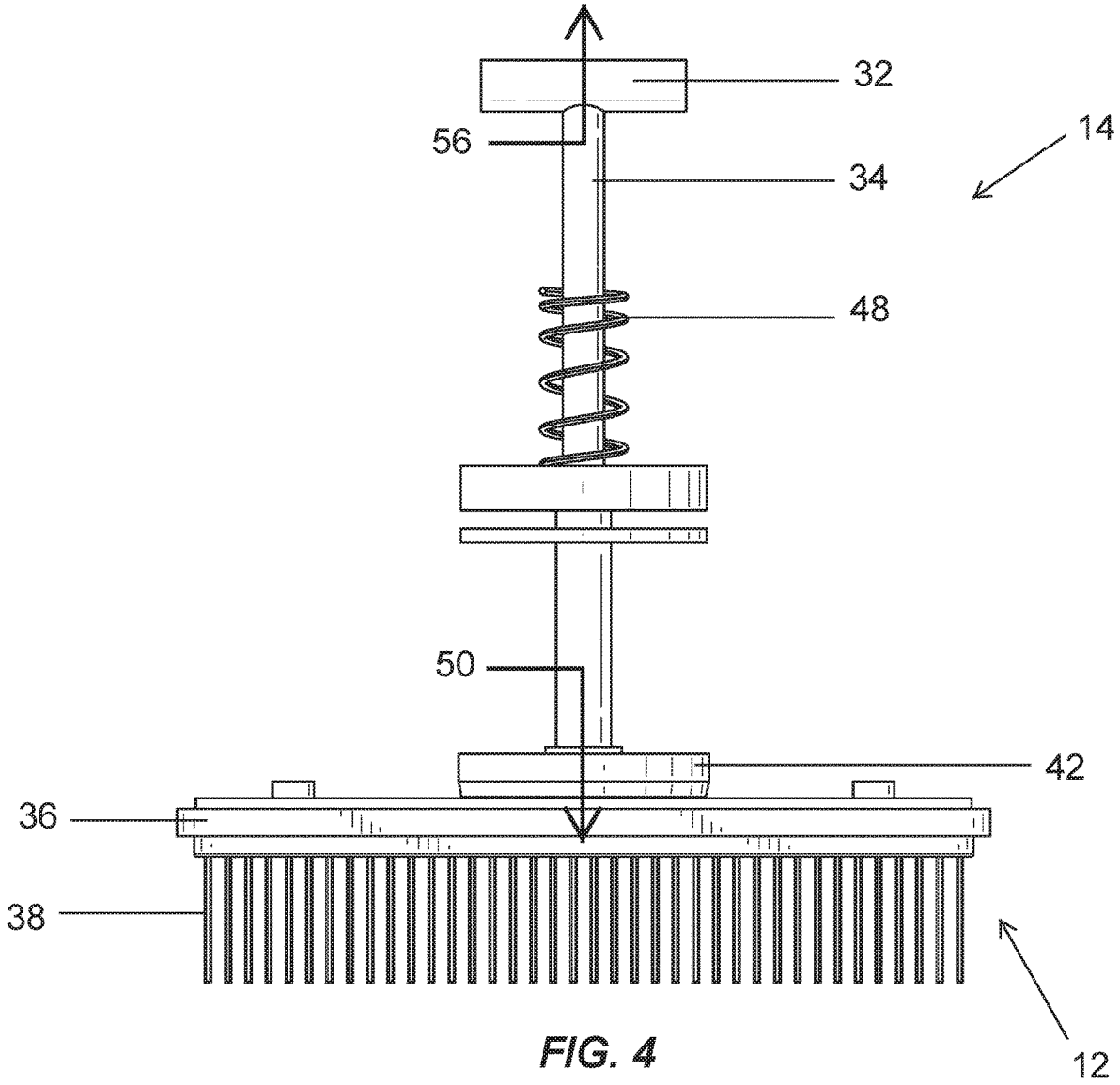
FIG. 4 is a side view of the filter cleaning device of FIG. 3.
Figure 5:
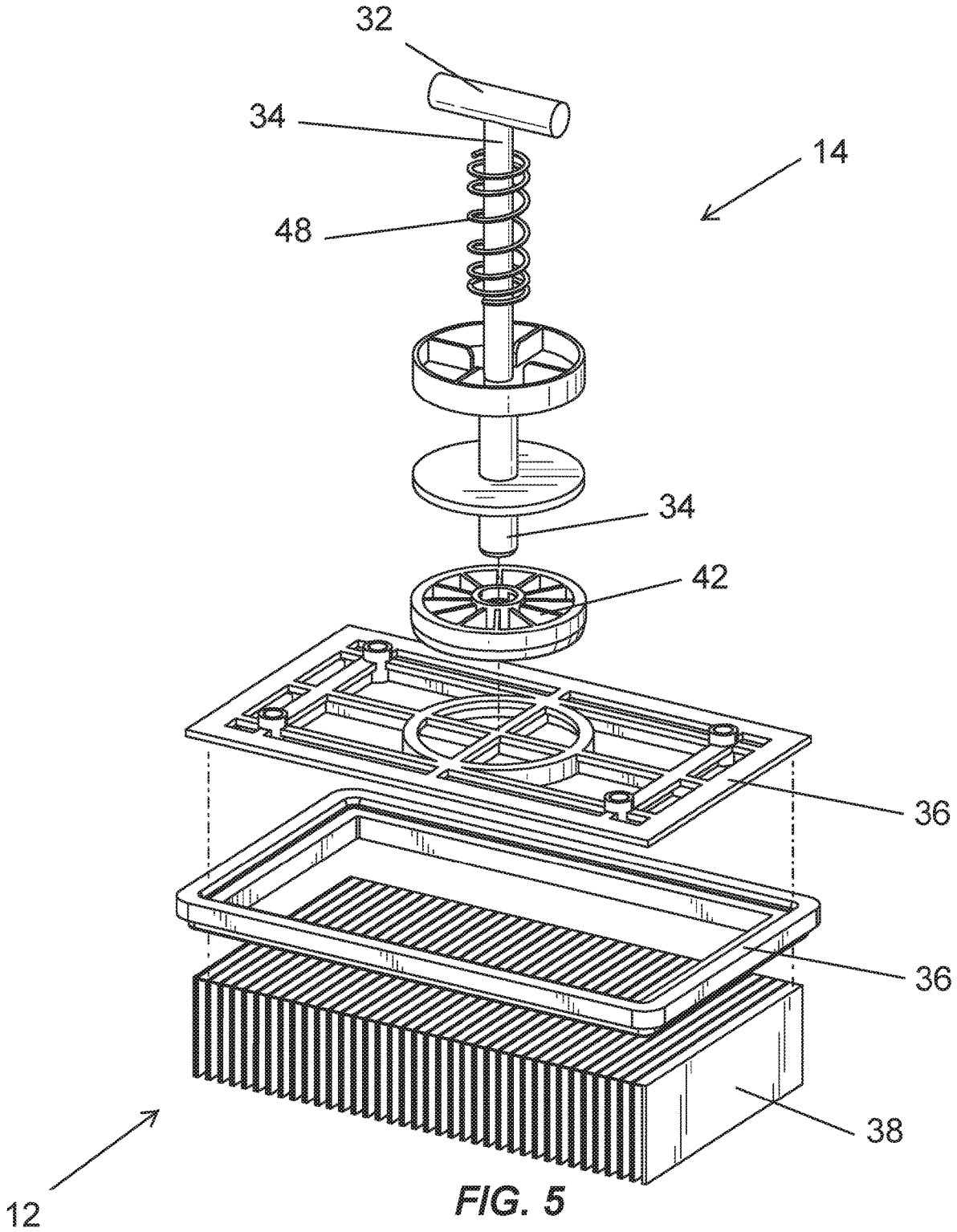
FIG. 5 is an exploded view of the filter cleaning device of FIG. 3.

Referring to FIGS. 3-5, the filter cleaning device 14 further includes a housing 40, and a contacting block 42. The handle 32 is located outside of the housing 40 and the handle 32 is configured to be grabbed and pulled by a hand of a user. The handle 32 is connected to the retractable member 34 to move the retractable member 34 relative to the housing 40 in directions toward and away from the filter 12. A seal or seals 44 are located on the retractable member 34 between the retractable member 34 and the housing 40. The seals 44 inhibit undesirable air infiltration into the housing 40 between the retractable member 34 and the housing 40 when the filter cleaning device 14 is in the position illustrated in FIGS. 3 and 4 (i.e., when the handle 32 is released) during normal operation of the vacuum cleaner 10. When the handle 32 is pulled to a position away from filter 12, a small gap is created between the seals 44 and the housing 40. The gap allows air to pass into the housing 40 between the housing 40 and the seals 44. The gap creates an airflow that bypasses the inlet 30, which reduces the airflow across the filter 12. The reduction in airflow across the filter 12 increases the effectiveness and makes it easier for the filter cleaning device 14 to dislodge or knock debris off the filter 12 as discussed below.

In other embodiments, the seals 44 contact the housing 40 to seal against the housing 40 when the handle 32 is pulled away from the filter 12. The seals 44 continue to seal against the housing 40 as the handle 32 and the retractable member 34 move between positions towards and away from the filter 12 and air is inhibited from flowing past the seals 44 into the housing 40. The area inside the housing 40 between the seals 44 and the filter 12 is under a vacuum (e.g., less than atmospheric pressure) when the suction source 16 is operating. The seals 44 inhibit undesirable air infiltration into the housing 40 between the retractable member 34 and the housing 40.

The block 42 is coupled to the retractable member 34 adjacent the filter 12 and opposite the handle 32. A biasing member 48 biasing the block 42 in the direction of arrow 50 of FIG. 4 toward the filter 12. In the illustrated embodiment, the biasing member 48 includes a coil spring that is coupled to the retractable member 34 and the filter housing 40 between the block 42 and the handle 32. In other embodiments, other suitable types of biasing members 48 can be utilized and the biasing member 48 may be in other suitable locations. For example, the biasing member 48 can be located between the retractable member 34 and the housing 40 to bias the block 42 towards the filter 12 (i.e., in the direction of arrow 50).

In operation, the suction source 16 draws the suction airflow and debris through the inlet 26 of the vacuum 10 and into the dirt collector 18. Dirt or debris is separated from the suction airflow in the dirt collector 18 (e.g., by gravity, cyclonic action, and/or the like) and the separated dirt falls to the bottom of the dirt collector 18. The suction airflow then travels through the filter 12 and the filter 12 removes relatively fine dirt or debris from the suction airflow. The relatively clean air then travels through the suction source 16 before being exhausted through an outlet 54 of the lid 26.

The user can use the filter cleaning device 14 to periodically clean or dislodge debris from the filter 12, which causes the dislodged debris to fall into the dirt collector 18. To operate the filter cleaning device 14, the user pulls on the handle 32 in the direction of arrow 56 in FIG. 4. This causes the block 42 to move in the same direction (i.e., away from the filter 12) and against the biasing force of the biasing member 48 such that the biasing member 48 is in a state of tension. The user pulls the handle 42 and block 42 away from the filter 12 in the direction of arrow 56 to a first position. The distance between the filter 12 and the first position is less than the length of the retractable member 34. The biasing member 48 suddenly moves the block 42 in the direction of arrow 50, which causes the block 42 to momentarily impact the center of the filter frame 36. The sudden impact of the block 42 against the frame 36 provides a shuttering force and vibrates the filter media 38 to dislodge debris from the filter 12. At rest, the retractable member 34 is in a second position where the retractable member 34 is in contact with the filter 12. The user can repeat the cleaning operation as desired. Cleaning the filter 12 extends the life of the filter 12 and reduces the frequency of filter 12 replacement.

In another embodiment, the filter cleaning device 14 is configured for use in a utility style vacuum cleaner 10. The filter cleaning device 14 can be configured for use in other style vacuum cleaners. Also, as used herein, the term vacuum cleaner includes other types of devices that filter debris from air, including dust extractors, air purifiers, and the like. For example, a dust extractor style vacuum cleaner may include the filter cleaning device 14 discussed above. The dust extractor style vacuum cleaner includes a suction source and a dirt collector. The dust extractor style vacuum cleaner further includes a filter. The suction source draws a suction airflow through the vacuum cleaner as represented and described in the illustrated embodiment. Debris is separated and retained in the dirt collector 18 and the filter 12 further separates relatively fine debris from the suction airflow. The filter cleaning device 14 is operated as discussed above to dislodge debris from the filter of the dust extractor style vacuum cleaner, and gravity causes the dislodged debris to fall into the dirt collector.

As another example, the filter cleaning device 14 discussed above may be utilized in a backpack style vacuum cleaner. The backpack style vacuum cleaner includes a shoulder harness that allows the user to wear the backpack style vacuum cleaner on the user's shoulders and back like a backpack. The backpack style vacuum cleaner includes a housing and a dirt separator and collector. A suction source and a filter are located inside the housing of the backpack style vacuum cleaner and the filter cleaning device 14 is operated as discussed above to dislodge debris from the filter and gravity causes the dislodged debris to fall into the dirt collector of the backpack style vacuum cleaner.

What is claimed is:

1. A vacuum cleaner comprising:

a housing including a suction airflow through the housing;

a suction inlet;

a suction source for drawing the suction airflow through the suction inlet;

a collector for receiving debris separated from the suction airflow, the collector being disposed between the suction inlet and the suction source;

a filter for filtering the suction airflow;

a retractable member operable in directions toward and away from the filter for momentarily impacting the filter, the impact to the filter providing agitation to rid the filter from debris;

a handle connected to the retractable member and moveable therewith in directions toward and away from the filter; and a biasing member urging the retractable member towards the filter;

wherein the handle is located outside of the housing and configured to be grabbed and pulled by a hand of a user.

2. The vacuum cleaner of claim 1, wherein the housing includes a lid for supporting the suction source.

3. The vacuum cleaner of claim 2, wherein the lid is removably coupled to the collector.

4. The vacuum cleaner of claim 3, wherein the suction source includes a motor and a fan.

5. The vacuum cleaner of claim 1, wherein the suction airflow enters the housing through the suction inlet.

6. The vacuum cleaner of claim 5, wherein the suction airflow is drawn through the suction inlet of the housing and passes through the collector before reaching the filter, debris carried in the suction airflow that is not deposited into the collector contacts the filtering, the filter includes a mesh or screen in fluid communication with the suction airflow such that no harmful amount of remaining debris is drawn through the suction source.

7. The vacuum cleaner of claim 1, wherein the filter is disposed in a flow path for the suction airflow between the collector and the suction source.

8. The vacuum cleaner of claim 7, wherein the filter collects debris, and the retractable member is used to strike the filter with an impact force for quaking debris from the filter.

9. The vacuum cleaner of claim 8, further comprising a filtering unit that includes the filter, wherein the retractable member is elongated and extends from the filtering unit out of the housing for a user to access the retractable member and deliver the impact force.

10. The vacuum cleaner of claim 1, wherein the biasing member is a spring.

11. The vacuum cleaner of claim 1, further comprising a handle connected to the retractable member, wherein the handle is operable with the retractable member in directions toward and away from the filter.

12. The vacuum cleaner of claim 11, wherein the handle is outside of the housing with respect to the filter.

13. A vacuum cleaner comprising:

a motor operable to generate a suction airflow;

a filter for collecting debris separated from the suction airflow upstream of the motor;

a retractable member movable between a first position and a second position; and a biasing member coupled to the retractable member, wherein when the retractable member is released at any position between the first and second position the biasing member drives the retractable member toward the second position for delivering a shuttering force against the filter;

wherein the retractable member is moveable while the vacuum cleaner is being operated to collect debris;

wherein the retractable member is elongated and selectively operable by a user; and wherein the retractable member impacts the filter in the center of the filter.

14. The vacuum cleaner of claim 13, wherein the filter includes a filter media for filtering debris.

15. The vacuum cleaner of claim 14, wherein the suction airflow is drawn in from an environment outside of the vacuum cleaner and passes through the filter before reaching the motor.

16. The vacuum cleaner of claim 13, further comprising a filter housing surrounding the filter and providing a filter compartment closed off from the surrounding environment.

17. The vacuum cleaner of claim 16, wherein the biasing member is coupled to the filter housing and the retractable member but not to the filter.

18. The vacuum cleaner of claim 17, wherein the biasing member is a coil spring.

19. The vacuum cleaner of claim 13, wherein the distance between the filter and the first position is less than the length of the retractable member.

20. A vacuum cleaner comprising:

a housing including a suction airflow through the housing;

a suction inlet;

a suction source drawing the suction airflow through the suction inlet;

a collector for receiving debris separated from the suction airflow, the collector being disposed between the suction inlet and the suction source;

a filter for collecting debris separated from the suction airflow, the filter positioned between the collector and the suction source;

a retractable member being operable away from the filter and toward the filter, the retractable member being separated from the filter in a first position and contacting the filter in a second position; and a biasing member urging the retractable member towards the filter, wherein when the retractable member is released from any position away from the filter, the biasing member drives the retractable member toward the filter for momentary impact between the retractable member and the filter;

wherein the retractable member is operable during operation of the vacuum cleaner.

* * * * *